US005482477A

United States Patent [19]

Michael

[11] Patent Number: 5,482,477

[45] Date of Patent: Jan. 9, 1996

[54] MICRO-MINIATURE COAXIAL CONNECTOR WITH POSITIVE LOCKING MEMBER

[75] Inventor: George W. Michael, Harrisburg, Pa.

[73] Assignee: The Whitaker Corporation, Wilmington, Del.

[21] Appl. No.: 266,921

[22] Filed: Jun. 28, 1994

[51] Int. Cl.[6] ..... H01R 9/05

[52] U.S. Cl. ..... 439/581; 439/63; 439/108

[58] Field of Search ..... 439/578–58.5, 439/854, 63, 394

[56] References Cited

U.S. PATENT DOCUMENTS

| | | | |
|---|---|---|---|
| 4,741,590 | 5/1988 | Caron | 439/369 |
| 4,741,703 | 3/1988 | Johnescu et al. | 439/63 |
| 4,892,491 | 1/1990 | Budano, II et al. | 439/852 |
| 5,110,308 | 5/1992 | Nishikawa et al. | 439/582 |
| 5,180,315 | 1/1993 | Nagashima | 439/581 |
| 5,326,280 | 7/1994 | Briones et al. | 439/581 |
| 5,371,323 | 12/1994 | Schneider et al. | 439/367 |

*Primary Examiner*—David L. Pirlot
*Attorney, Agent, or Firm*—William B. Noll

[57] ABSTRACT

A micro-miniature coaxial cable connector and surface mount receptacle assembly is provided that has a positive locking mechanism (60) for holding the cable connector in engagement with the receptacle without increasing the force needed to separate the connector assembly. The locking mechanism (60) has a body (62), a pair of arms (66) extending from one end of the body, and a latch (68) extending from an opposite end of the body. The body (60), the pair of arms (66), and the latch (68) are made from a spring material and are of unitary construction. The locking mechanism (60) is arranged so that when it is in locking position securing the cable plug connector (12) and receptacle (14) in assembled engagement, the arms (66) straddle a portion of the cable plug connector (12) and engage the base (26) of the housing (16) of the receptacle, the latch (68) latchingly engages one of the side surfaces (56) of the housing, and the body (62) substantially covers an opening (32) in the top surface (30) holding the cable plug connector (12) and receptacle (14) in assembled engagement.

8 Claims, 4 Drawing Sheets

MICRO-MINIATURE COAXIAL CONNECTOR WITH POSITIVE LOCKING MEMBER

The present invention relates to micro-miniature coaxial connectors and particularly to a locking member for securing a coaxial cable connector to its mating receptacle.

BACKGROUND OF THE INVENTION

Micro-miniature coaxial cable connector and receptacle assemblies are used in the telecommunications industry because of their very small size and light weight. Typically, the receptacle is surface mounted to a circuit board in a cellular telephone, pager, or other portable communications device that is carried by a person. The purpose of the micro-miniature connector and receptacle assembly is to easily interconnect certain components with circuitry on the circuit board and to provide a means for disconnecting them for maintenance of replacement. An example of such a cable connector assembly is disclosed in U.S. Pat. No. 5,110,308 which issued May 5, 1992 to Nishikawa et al. Since these communications devices are generally hand held units, they are sometimes subjected to somewhat rough handling which may cause the cable connector to disengage from its mating receptacle. When this occurs, of course, the unit is disabled. It is, therefore, desirable to provide means for locking the two parts together. This may be accomplished by increasing the interference between the two mating parts, as is done with the connector disclosed in U.S. Pat. No. 5,180,315 which issued Jan. 19, 1993 to Nagashima. A coaxial cable connector is utilized in the '315 patent and has an outer shell contact that includes a segmented annular rib that resiliently engages a recess in the mating receptacle contact, thereby holding the two parts together by friction. When separating the two parts, the segmented annular rib is elastically deflected outwardly away from the groove. This, however, increases the amount of force that is necessary to disconnect the cable connector from the receptacle. When sufficient friction is achieved to prevent inadvertent unmating of the cable connector from the receptacle, the force required to disconnect is so great that the solder connections between the receptacle and the circuit board may be compromised, and the receptacle may even be pulled from the circuit board. Other types of latching mechanisms that may be incorporated into the housings of the two mating parts require a substantial amount of space, usually in the form of thicker housing walls that translate into a larger mounting foot print. This is an obvious disadvantage in the present application where the physical size of the cable connector and mating receptacle must be minimized. Such micro-miniature connector and receptacle assemblies must, by necessity, be kept small. For example, for a coaxial cable having an outside diameter of about 0.070 inch, the corresponding cable plug connector would have a nominal diameter of about 0.120 inch and the mating receptacle would have a width of about 0.215 inch and a height of about 0.145 inch. Note that these dimensions include the insulating housings and the mating contacts for both the ground and signal conductors in the coaxial cable. There is little room for an integral latching mechanism.

What is needed is a micro-miniature coaxial cable connector and surface mount receptacle assembly that has a positive locking mechanism for holding the cable connector in engagement with the receptacle without increasing the force needed to separate the connector assembly and without increasing the amount of space required for mounting on a circuit board.

SUMMARY OF THE INVENTION

A positive locking member is disclosed that is arrangeable in a locking position for securing a low profile coaxial cable plug connector in assembled engagement with a mating micro-miniature receptacle. The receptacle includes a housing having a top surface and an opening therein for receiving the plug cable connector, a base for surface mounting to a substrate, and side surfaces extending from the top to the base. The positive locking member includes a body, a pair of arms extending from a first end of the body, and a latch extending from a second end of the body opposite the first end. The body, pair of arms, and latch are of unitary construction and are arranged so that when the locking member is in locking position securing the plug cable connector and receptacle in assembled engagement, the arms straddle a portion of the plug cable connector and engage the base of the housing. The latch latchingly engages one of the side surfaces of the housing, and the body substantially covers the opening in the top surface and holds the plug cable connector and receptacle in assembled engagement.

DESCRIPTION OF THE PREFERRED EMBODIMENT

Figure 1:
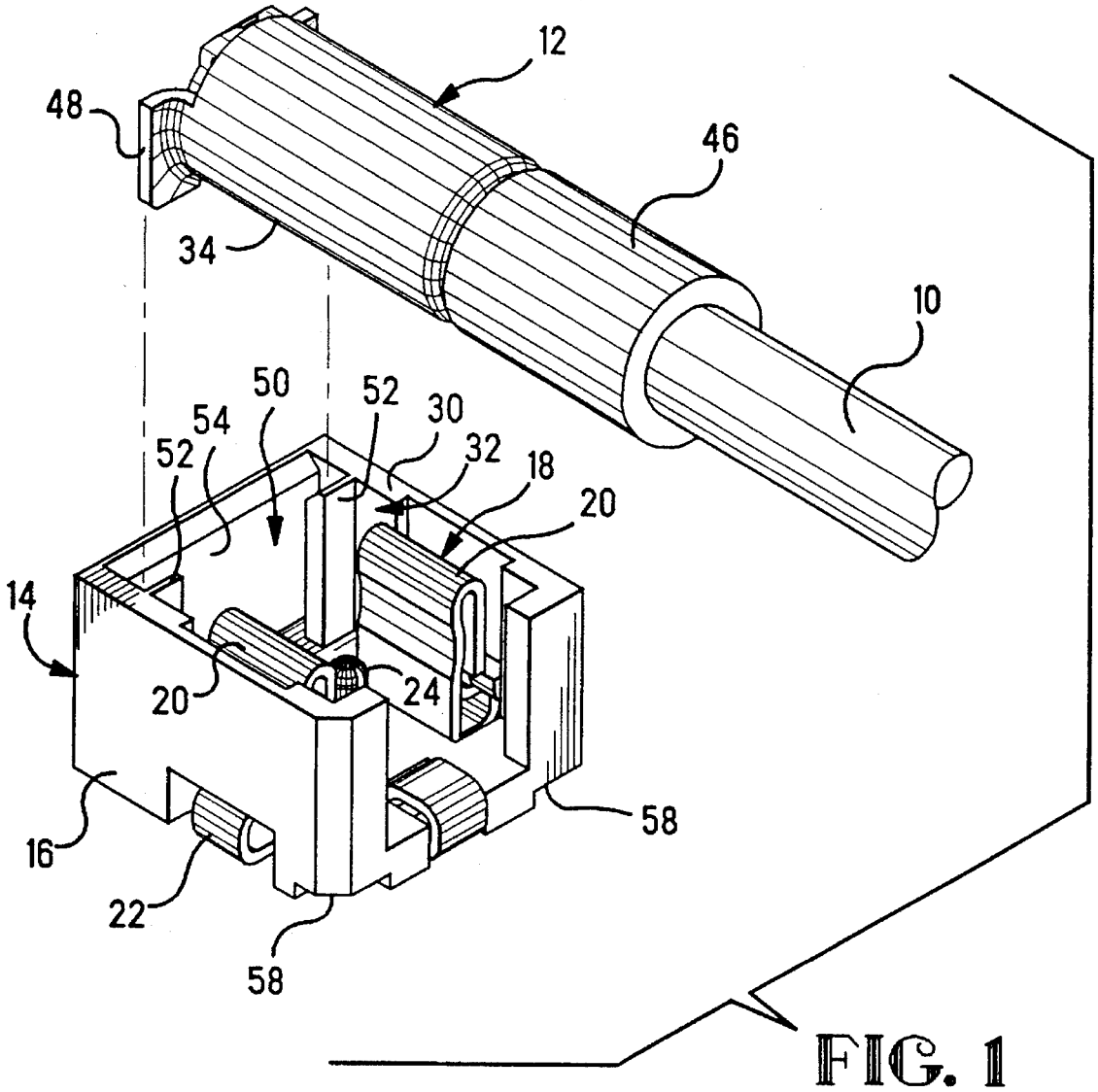
FIG. 1 is an isometric view of a micro-miniature coaxial cable connector and receptacle assembly.
Figure 3:
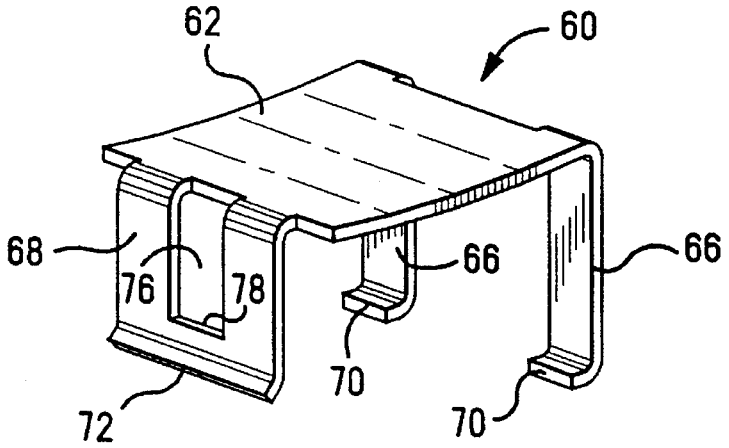
FIG. 3 is an isometric view of a positive locking member incorporating the teachings of the present invention.
Figure 2:
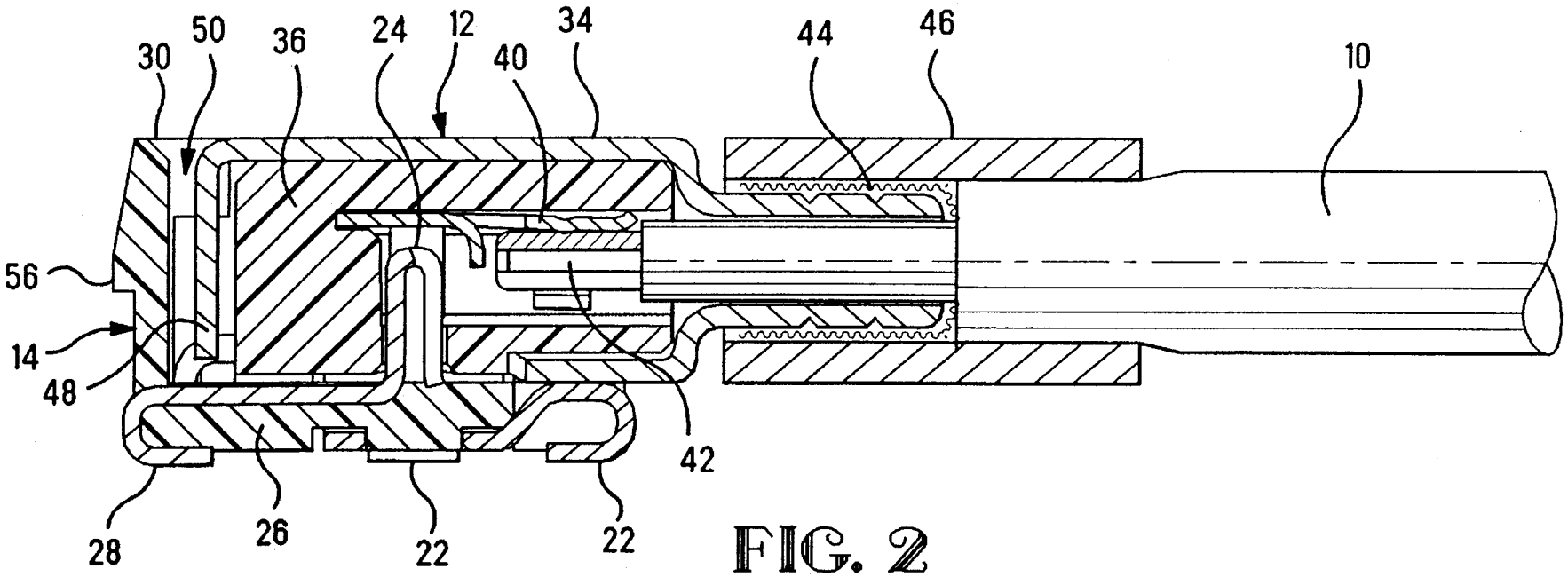
FIG. 2 is a longitudinal cross-sectional view of the assembly shown in FIG. 1.
Figure 7:
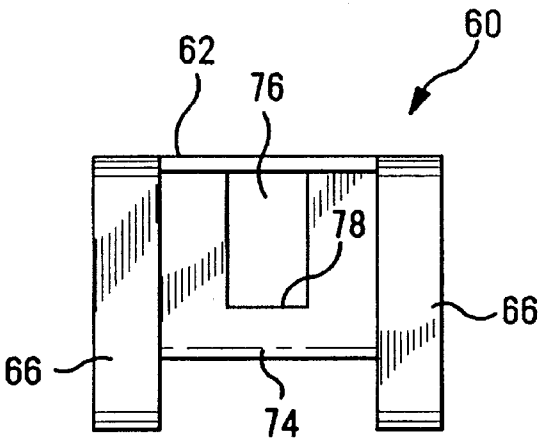
FIGS. 4, 5, 6, and 7 are front, top, left side, and right side views, respectively, of the locking member of FIG. 3.
Figure 5:
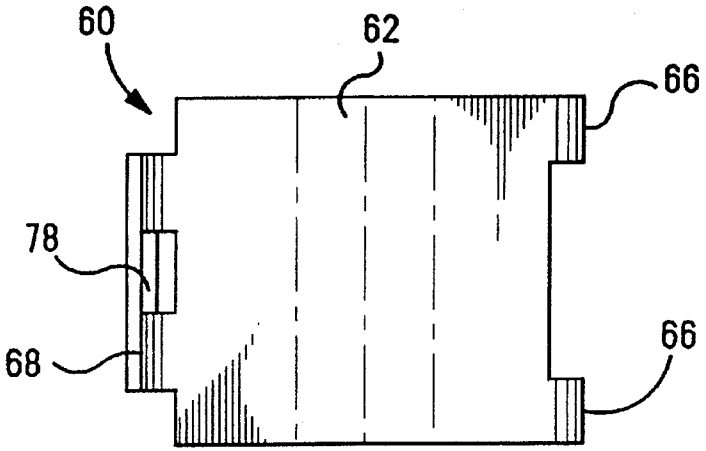

There is shown in FIGS. 1 and 2 a coaxial cable 10 terminated to a micro-miniature coaxial cable plug connector 12, and a receptacle 14 for receiving the connector 12. The receptacle 14 includes an insulating housing 16, a stamped and formed ground contact 18 having a pair of opposed resilient contact members 20 and surface mountable solder tails 22, and a stamped and formed signal contact 24 that is integrally molded into a base 26 of the housing 16 and having a solder tail 28. The housing 16 includes a top surface 30 with an opening 32 for receiving the cable connector 12. The cable connector 12 includes a stamped and formed or drawn metal shell 34, a dielectric insert 36 having a central cavity with a stamped and formed contact 40 therein that mates with the contact 24. The center conductor 42 is terminated to the contact 40 in the usual manner, while the outer shield conductor 44 is terminated to the shell 34 by means of a crimped ferrule 46. The shell 34 includes a pair of outwardly projecting tabs 48 that, when mated to the receptacle 14, locate within a cavity 50 formed by a pair of ribs 52 and an end wall 54 of the housing 16. When the cable plug connector 12 is in assembled engagement with the receptacle 14, as shown in FIG. 2, the contact 40, attached to the center conductor of the cable 10, is in electrical engagement with the signal contact 24. The outer surface of the shell 34 is in electrical engagement with the pair of contact members 20. A protrusion 56 extends from one side of the housing 16, as best seen in FIG. 2, and a pair of recesses 58 are formed in the base 26 adjacent the opposite side thereof, as best seen in FIG. 1, for a purpose that will be set forth below.

Figure 4:
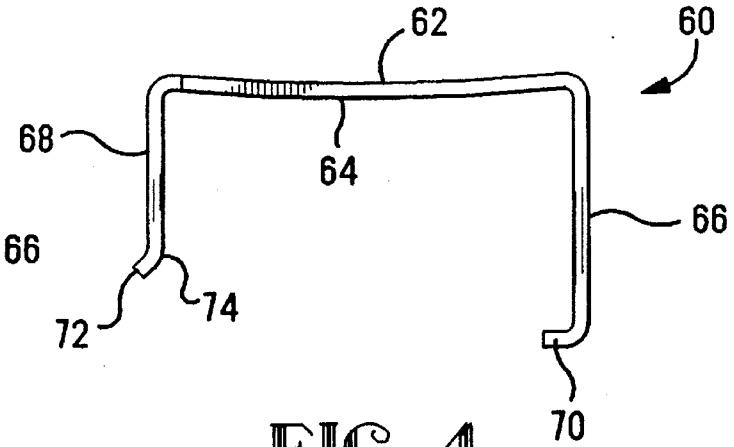
Figure 6:
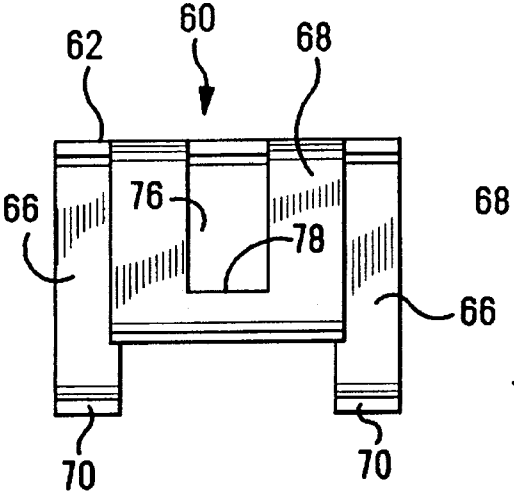

A positive locking member 60, as shown in FIGS. 3 through 7, has a body having a downwardly facing slightly convex surface 64, as best seen in FIG. 4, a pair of spaced arms 66, and a latch 68. Each of the arms 66 extends away from one end of the body 62, substantially perpendicular thereto, and includes a foot 70 that extends from the free end of the arm approximately perpendicular thereto so that it is vertically under the body, as viewed in FIG. 4. The latch 68 extends away from the other end of the body 62, substantially perpendicular thereto, its free end 72 being turned outwardly to form a camming surface 74. The latch 68 includes a latch opening 76 having a catch surface 78 adjacent the free end 72. The locking member 60 is made of a suitable spring material, beryllium copper in the present example, so that the body 62, arms 66, and latch 68 are elastically resilient and may be deflected substantially without taking a set. Other materials suitable for making the locking member 60 include other copper based materials and stainless steel.

Figures 8, 9:
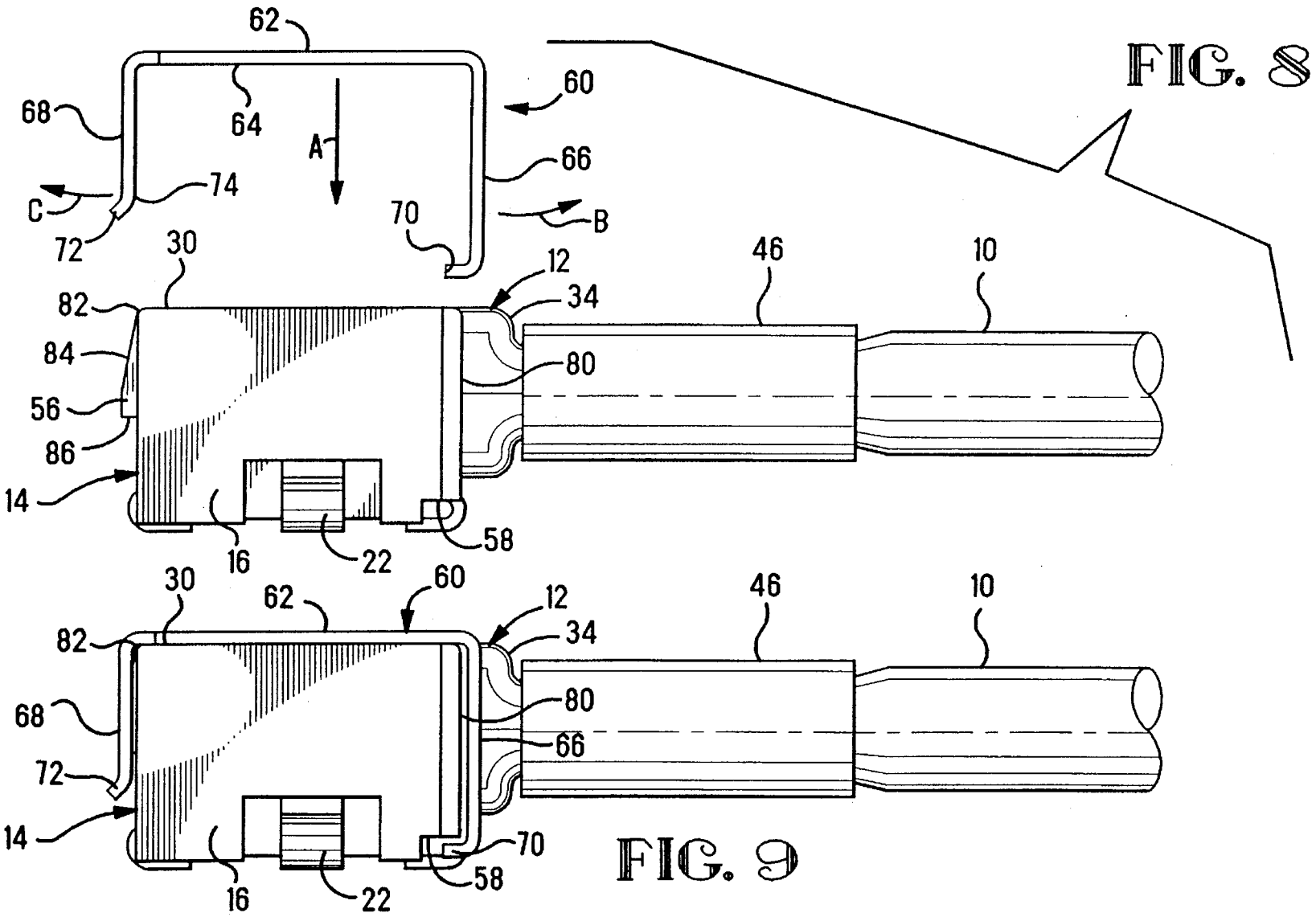
FIG. 8 is a front view of a micro-miniature coaxial cable connector and receptacle assembly showing the locking member of FIG. 3 prior to installation thereof.
FIG. 9 is a view similar to that of FIG. 8 showing the locking member fully installed in locking position.

In operation, the plug connector 12 with attached cable 10 is mated to the receptacle 14 so that the two are in assembled engagement as shown in FIG. 2. The locking member 60 is then positioned vertically above the connector assembly, as best seen in FIG. 8. The locking member 60 is moved downwardly, as indicated by the arrow A in FIG. 8, so that the feet 70 engage and slide along a side 80 of the housing. As downward movement continues, the two arms 66 straddle a portion of the cable plug connector 12 and the camming surface 74 engages and rides over the corner 82 of the housing 16 thereby causing the arms 66 and latch 68 to deflect slightly outwardly as indicated by the arrows B and C, respectively. As movement continues, the camming surface 74 rides along a beveled surface 84 of the protrusion 56 until the catch surface 78 reaches the end 86 of the protrusion and snaps against the end surface of the housing 16 in latching engagement with the end 86. Concurrently, the feet 70 continue sliding along the surface 80 until they reach the recesses 58 and snap thereinto. At this point the locking member 60 is in locking position where the body 62 substantially covers the opening 32 in the top 30 of the housing. The convex surface 64 is in engagement with the top of the cable plug connector 12, as shown in FIG. 9, thereby positively locking the cable plug connector 12 and receptacle 14 in assembled engagement. The locking member 60 may be removed by prying the end 72 away from the housing 16 until the catch surface 78 is clear of the end 86, then lifting the latch 68 upwardly in the direction of the arrow D, shown in FIG. 9, while the feet 70 pivot within their recesses 58 until the locking member 60 is clear of the assembled plug connector 12 and receptacle 14.

An important advantage of the present invention is that the micro-miniature cable connector and receptacle are releasably locked in mated engagement without increasing the force required for mating or separating the two parts. Additionally, the circuit board footprint of the receptacle is maintained relatively small and substantially unaffected by the locking member. The present locking member effects positive locking of the two parts that remains effective even under conditions of severe vibration and rough handling.

I claim:

1. A positive locking member arrangeable in a locking position for securing a low profile coaxial cable plug connector in assembled engagement with a mating micro-miniature receptacle, said receptacle including a housing having a top surface and an opening therein for receiving said cable plug connector, a base for surface mounting to a substrate, and side surfaces extending from said top to said base, said positive locking member comprising:

(a) a body;

(b) a pair of arms extending from a first end of said body;

(c) a latch extending from a second end of said body opposite said first end, wherein said body, pair of arms, and latch are of unitary construction and arranged so that when said locking member is in said locking position securing said cable plug connector and receptacle in said assembled engagement, said arms straddle a portion of said cable plug connector and engage said base of said housing, said latch latchingly engages one of said side surfaces of said housing, and said body substantially covers said opening in said top surface and holds said cable plug connector and receptacle in said assembled engagement.

2. The positive locking member according to claim 1 wherein said body, pair of arms, and latch are elastically resilient so that when assembled to said cable plug connector and receptacle, said body, arms, and latch elastically deflect and then resile into place in said locking position.

3. The positive locking member according to claim 1 wherein each said arm includes a foot portion that extends substantially perpendicular from an end of said arm and into said assembled engagement with said base.

4. The positive locking member according to claim 1 wherein said body has a convex surface extending therefrom so that said convex surface engages said cable plug connector when said locking member is in said locking position.

5. The positive locking member according to claim 1 wherein said pair of arms and said latch extend from said body in a first direction that is substantially perpendicular thereto.

6. The positive locking member according to claim 1 wherein said one side surface of said housing includes a projection and said latch includes an opening for latchingly receiving said projection when said locking member is in said locking position.

7. The positive locking member according to claim 6 wherein said projection has a beveled surface facing said top surface of said housing and said latch has a complementary camming surface that engages said beveled surface and deflects outwardly over said projection when assembling said locking member to said housing.

8. The positive locking member according to claim 7 wherein said locking member is stamped and formed from a spring material.

* * * * *